US008783800B2

(12) United States Patent
Benigni

(10) Patent No.: US 8,783,800 B2
(45) Date of Patent: Jul. 22, 2014

(54) REFRIGERATOR AND/OR FREEZER

(75) Inventor: Karl Benigni, Oberdrauburg (AT)

(73) Assignee: Liebherr-Hausgerate Lienz GmbH (AT)

( * ) Notice: Subject to any disclaimer, the term of this patent is extended or adjusted under 35 U.S.C. 154(b) by 278 days.

(21) Appl. No.: 12/979,501

(22) Filed: Dec. 28, 2010

(65) Prior Publication Data

US 2011/0154851 A1 Jun. 30, 2011

(30) Foreign Application Priority Data

Dec. 29, 2009 (DE) ..... 10 2009 060 682

(51) Int. Cl.
*A47B 88/00* (2006.01)

(52) U.S. Cl.
USPC ..... 312/402

(58) Field of Classification Search
USPC ..... 312/348.4, 348.1, 330.1, 348.2, 265.5, 312/265.6, 257.1, 402, 404, 223.6; 403/321, 323, 225, 322.1, 322.4
See application file for complete search history.

(56) References Cited

U.S. PATENT DOCUMENTS

| | | | | |
|---|---|---|---|---|
| 4,595,245 | A * | 6/1986 | Rock et al. | 312/265.1 |
| 4,961,614 | A * | 10/1990 | Rock | 312/348.4 |
| 5,076,723 | A * | 12/1991 | Berger | 403/12 |
| 5,375,922 | A * | 12/1994 | Brustle et al. | 312/334.4 |
| 5,460,443 | A * | 10/1995 | Ferrari et al. | 312/348.4 |
| 5,540,515 | A * | 7/1996 | Rock et al. | 403/322.4 |
| 6,220,682 | B1 * | 4/2001 | Vertullo | 312/334.28 |
| 6,609,774 | B2 * | 8/2003 | Banicevic et al. | 312/330.1 |
| 7,107,785 | B2 | 9/2006 | Bärmann, et al. | |
| 8,141,968 | B2 * | 3/2012 | Velarde et al. | 312/402 |
| 8,262,175 | B2 * | 9/2012 | Lam et al. | 312/348.4 |
| 8,297,724 | B2 * | 10/2012 | Hammerle | 312/348.4 |
| 2003/0234603 | A1 * | 12/2003 | Salice | 312/334.5 |
| 2008/0074019 | A1 * | 3/2008 | Park et al. | 312/236 |
| 2009/0058243 | A1 * | 3/2009 | Weber | 312/348.4 |
| 2009/0174299 | A1 * | 7/2009 | Lam et al. | 312/348.4 |

FOREIGN PATENT DOCUMENTS

| | | | |
|---|---|---|---|
| DE | 196 44 734 C1 | | 5/1998 |
| EP | 1 903 288 A2 | | 3/2008 |
| WO | 2009056326 | * | 5/2009 |

OTHER PUBLICATIONS

German Search Report corresponding to European Application No. 10 01 6054, completed on Aug. 21, 2013 and mailed on Aug. 28, 2013; 3 pages.

* cited by examiner

*Primary Examiner* — Janet M Wilkens
(74) *Attorney, Agent, or Firm* — Carter, DeLuca, Farrell & Schmidt, LLP

(57) ABSTRACT

A refrigerator and/or freezer with at least one inside container and at least one drawer which can be slid into and pulled out of the inside container. The drawer has at least one face visible to a user of the equipment and is provided with adjustment devices for changing the position of the drawer and/or the position of the drawer face relative to the inside container in at least one direction. The adjustment devices have at least one eccentric.

11 Claims, 2 Drawing Sheets

REFRIGERATOR AND/OR FREEZER

This application claims priority to German Application No. 10 2009 060 682.3, filed Dec. 29, 2009, the entirety of which is hereby incorporated by reference.

The within invention concerns a refrigerator and/or freezer with at least one inside container and with at least one drawer, which can be slid into and pulled out of the inside container, with the drawer having at least one face visible to a user of the equipment.

Refrigerators and/or freezers having compartments with one or more drawers are known from the state of the art. When in inserted position, these drawers rest tightly, by means of a magnetic seal, on a front surface of the inside container or the housing.

The drawers have a face that forms the extension or drawer surface that is visible to a user when the refrigerator and/or freezer is closed.

To facilitate a uniform view of the joint, it is known from the state of the art that the position of the drawer face or the drawer itself can be changed. For this purpose, in existing equipment there are longitudinal holes that permit a horizontal change of position of the drawer or the drawer face.

It can happen, however, that the adjustment is not identical on both sides of the drawer, which when the drawer is pulled out can lead to distortions that shorten useful life.

It is therefore the task of the within invention to improve on a refrigerator and/or freezer of the type initially indicated so that the possibility of a simple and reliable adjustment of the drawer or the drawer face is ensured.

Figure 1:
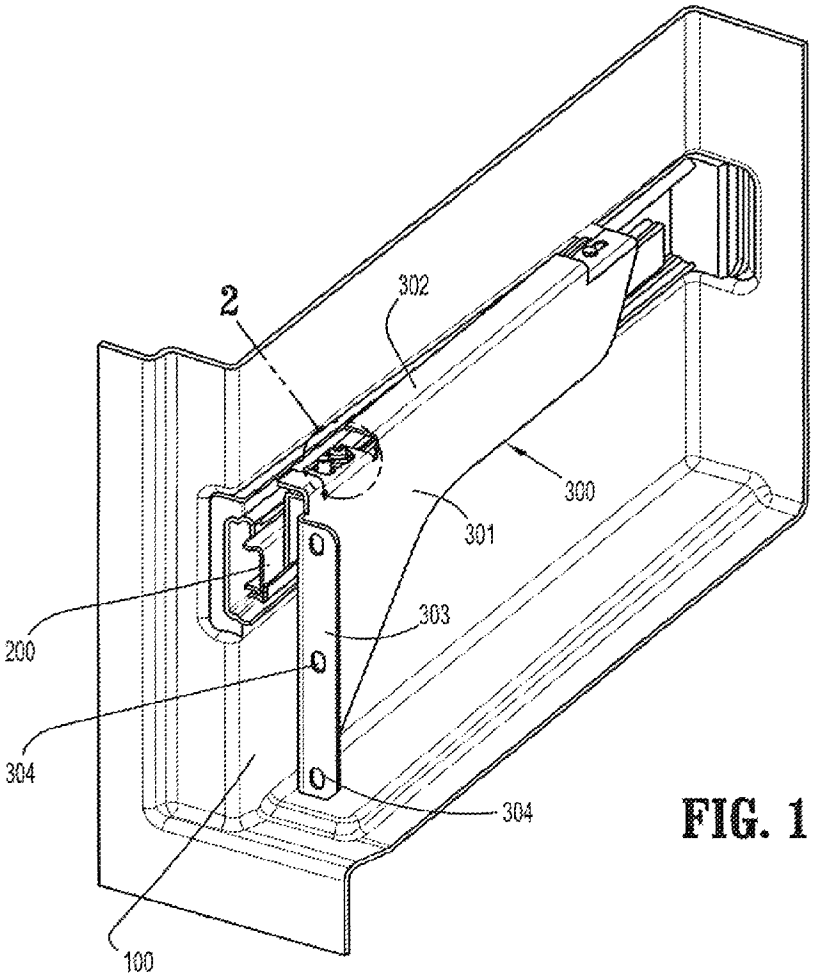
FIG. 1 is a perspective view of a portion of a drawer a track for the drawer, a stop and an adjustment mechanism according to the present disclosure.

This task is performed by a refrigerator and/or freezer with the characteristics described herein which provides for adjustment devices by means of which the position of the drawer relative to the inside container can be shifted in at least one direction, with the adjustment device having at least one eccentric. The drawer and/or the drawer face is adjusted with the help of one or more eccentrics, by means of which a simple and precise adjustment of position is possible.

The eccentric(s) can have markings or similar indicators by means of which the position of the eccentric and hence also the position of the drawer or drawer face relative to the inside container or the housing can be perceived by a user.

The adjustment devices can be constructed in such manner that the position of the drawer relative to the inside container is adjustable sideways and/or upward, preferably horizontally and/or vertically.

Preferably, at least two eccentrics are provided, one positioned on or near a side wall of the drawer, or one acting on one side wall or other part of the drawer or a part connected with the drawer.

It is thus possible to adjust the two side walls of the drawer evenly in the desired adjustable position by means of an eccentric.

Provision can also be made for the drawer to slide into and to be pulled out of the inside container by means of an extension track, and for the adjustment device to be at least partly positioned on the extension track.

The extension track can conceivably have a stationary part and a part that slides relative to this stationary part, and the adjustment device can conceivably be at least partially positioned on the stationary part or on the sliding part of the extension track.

For example, the adjustment device can conceivably have at least one bolt and at least one eccentric positioned on or near the bolt and capable of turning together with the pin or in relation to the pin.

The eccentric or the bolt, which is immovably connected with the eccentric, can have a section with marking visible to a user, so that the angular position or rotation position of the eccentric is perceptible.

In addition, the eccentric can have at least one adjustment section that acts on the drawer or the drawer face or on a part connected with the drawer or the drawer face in order to make the adjustment. This adjustment section can be constructed as, for example, a disc or similar device positioned on the bolt. Preferably, the disc ex tends in a plane perpendicular to the longitudinal axis of the bolt.

In one preferred embodiment of the invention, the drawer has at least one stop, and the adjustment device coordinates with the stop. The drawer can conceivably have a stop on each of its side walls.

Preferably, the drawer face is at least positioned on a stop, preferably it is screwed to this stop.

The minimum of one stop can be connected with the retractable portion of an extension track in such manner that it can be pulled out and pushed in with the extension track. In addition, the stop can have an elongated hole in which a pin connected with the extension track projects, and which functions as a catch. If the user exerts pressure on the drawer face, this pressure is transmitted via the pin to the extension track. The minimum of one stop can be connected with the extensible portion of an extension track in such manner that it can be pulled out and pushed in with the extension track. In addition, the stop can have an elongated hole into which a pin connected with the extension track projects, and which functions as a catch. If the user exerts pressure on the drawer face, this pressure is transmitted via the pin to the extension track.

As explained, the stop can be connected with an extension track, by means of which the drawer can be slid into and pulled out of the inside container.

The stop can have at least one hole, through which a bolt extends, with at least one eccentric being positioned on the bolt.

The eccentric according to the invention is positioned in such manner that when it turns, the position of the drawer and/or the drawer face relative to the inside container is changed.

Additionally, the said bolt can be made immobile in the direction in which the drawer position is adjustable by means of the adjustment device. For example, if the drawer or its face is adjustable sideways or horizontally, provision can be made for the bolt to be non-adjustable sideways or horizontally and to be positioned immovably in this direction.

Additionally, the stop can conceivably have a wall, a stud, or another projection, or also a hole or recess, and the eccentric can act on the wall, the stud, the projection, the hole, or the recess. When the eccentric is turned, the stop or other part of the drawer is slid through the outer surface of the eccentric, depending on the rotation position of the eccentric, thereby facilitating an exact positioning of the drawer or drawer face.

The eccentric can conceivably be positioned in a hole or recess of the stop in such manner that the position of the drawer or the drawer face is adjusted by the action of the eccentric on the walls of the hole or recess.

Further details and advantages of the within invention can be described in greater detail by means of an embodiment illustrated in the drawings.

FIG. 1 shows, with reference sign 100, an inside container of a refrigerator and/or freezer.

Extension tracks 200 are positioned in inside container 100, in recesses on the two side walls of inside container 100. Said extension tracks 200 have an immobile part attached to inside container 100, and a part that is mobile relative thereto.

A stop elbow 300 is positioned on the mobile portion of each of the two extension tracks 200.

Stop elbow 300 has a flat and/or side area 301 that is positioned parallel to the side wall of a drawer not illustrated in FIG. 1. In the angle to flat area 301, a flange 302 extends on the top of stop elbow 300 in the angle, and a flange 303 similarly extends on the face side of stop elbow 300.

Figure 7:
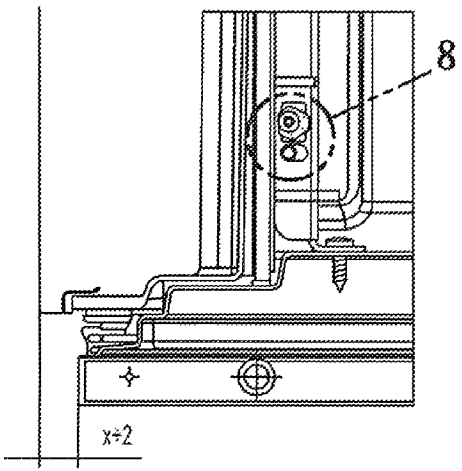
FIG. 7 is a top sectional view of a portion of a drawer, a track for the drawer, a stop and an adjustment mechanism in a 2 mm to the right adjustment position according to the present disclosure.
Figure 5:
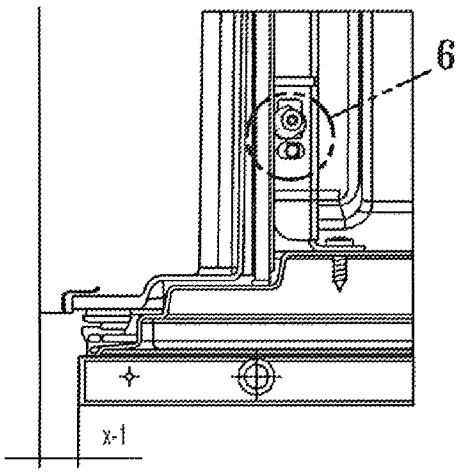
FIG. 5 is a top sectional view of a portion of a drawer, a track for the drawer, a stop and an adjustment mechanism in a 1 mm to the left adjustment position according to the present disclosure.
Figure 3:
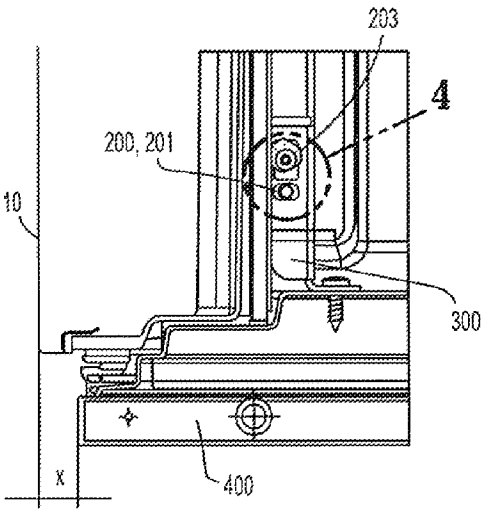
FIG. 3 is a top sectional view of a portion of a drawer, a track for the drawer, a stop and an adjustment mechanism in a null or zero adjustment position according to the present disclosure.

On the flange 303 forming the face side of stop elbow 300, there are one or more holes 304, by means of which a drawer face 400 can be immovably screwed to the stop elbow 300, as is evident from the illustrations according to FIGS. 3, 5 and 7.

Figure 2:
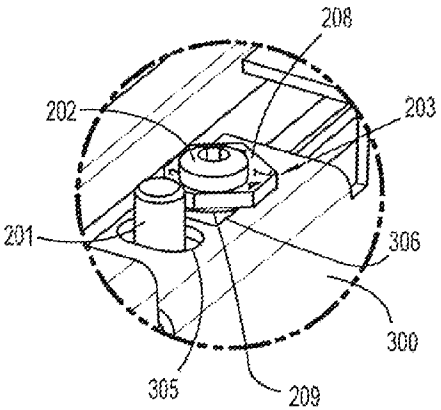
FIG. 2 is an enlarged view of the adjustment mechanism shown in FIG. 1.

In the flange 302 forming the top side of stop elbow 300, or in an area set back opposite flange 302, there are two holes 305 and 306, illustrated in detail in detail illustration FIG. 2. Detail illustration FIG. 2 shows the adjustment mechanism according to the invention.

A pin 201 extends through one of the holes 305, which said pin 201 is connected immovably with the retractable and slideable portion of extension track 200. Hole 305 is constructed as a longitudinal hole that extends in the direction of adjustment of drawer or drawer face 400. If the position of the drawer or drawer face 400 is adjusted, pin 201 moves relative to the longitudinal hole, as is evident from the illustrations according to FIG. 2.

However, in the extension direction of the drawer, pin 201 has no play in hole 305.

A rotatable pin 202 equipped with eccentric 203 and immovably connected with the retractable and slideable part of extension track 200 extends through the other hole 306.

The axis of rotation of bolt 202 extends perpendicular to the direction of adjustment of the drawer or drawer face 400. In the embodiment illustrated here, the axis of rotation of bolt 202 and bolt 202 itself are perpendicular.

Eccentric 203 has a first section 208 that has a marking by means of which the rotation position of eccentric 203 is perceptible. This marking is positioned in such manner that it can easily be seen by a user.

Additionally, eccentric 203 has a second section 209 connected immovably with first section 208 and positioned eccentrically to bolt 202. This section 209 is constructed as an eccentrically positioned disc that is positioned in hole 306 and the outer circumference of which, depending on the rotation position of eccentric 203, touches various areas of the walls of hole 306. In the embodiment illustrated here, the disc is positioned under section 208, which is also disc-shaped. Other positions are also theoretically possible. For example, sections 208 and 209 can conceivably be designed as a single component, for example an eccentric disc.

Eccentric 203 or bolt 202, which is immovably connected with eccentric 203, has, on its side accessible to a user, a machine-tool recess by means of which bolt 202 and hence also eccentric 203 can rotate.

FIGS. 3 through 8 illustrate various positions of drawer face 400 and stop elbow 300 that result from a rotation of eccentric 203.

Figure 8:
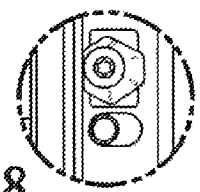
FIG. 8 is an enlarged view of the adjustment mechanism shown in FIG. 7.
Figure 6:
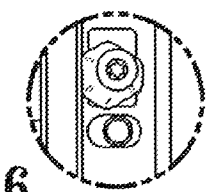
FIG. 6 is an enlarged view of the adjustment mechanism shown in FIG. 5.
Figure 4:
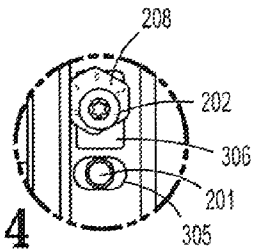
FIG. 4 is an enlarged view of the adjustment mechanism shown in FIG. 3.

The top view in FIGS. 3, 5 and 7 shows a sectional view through the drawer with its drawer face 400. FIGS. 4, 6 and 8 illustrate respective detail views of the position of eccentric 203.

When eccentric 203 stands in its zero position according to FIGS. 3 and 4, the result is a defined horizontal position "X" of stop elbow 300, and thus also of drawer face 400 relative to inside container 100 or housing 10 of the equipment. The first section 208 stands in position "0."

If eccentric 203 is turned counter-clockwise, starting from its position according to FIGS. 3 and 4, the result is the position of the eccentric according to FIGS. 5 and 6.

In so turning, eccentric 203 with its section 209 or its outside wall exerts a leftward pressure on the wall of hole 306 of stop elbow 300 according to FIGS. 5 and 6. This causes stop elbow 300 and with it the drawer and drawer face 400 to move leftward, so that starting from zero position X a leftward-shifted position "X-1" results. In the embodiment illustrated here, the drawer with drawer face 400 is shifted 1 mm to the left.

This shift results from the fact that the distance from the axis of rotation of bolt 202 to the outside circumference of section 209 of eccentric 203 changes. In the position illustrated in FIGS. 5 and 6, the distance of the axis of rotation to the area of section 209 that acts on the wail of hole 306 is larger than in zero position, and this leads to a leftward shift.

Starting from FIGS. 3 and 4, when bolt 202 is turned counterclockwise, section 209 presses the left wall of hole 306 to the left. This leads to the desired leftward displacement of stop elbow 300, until the position illustrated in FIGS. 5 and 6 is reached.

If eccentric 203 is turned clockwise, section 209 exerts pressure, on the right wall of hole 306, which results in a rightward shift of stop elbow 300 starting from zero position in FIGS. 3 and 4, as illustrated in FIGS. 7 and 8. In this case the position of stop elbow 300 is shifted 2 mm to the right, resulting in position "X+2."

These positions can be illustrated on eccentric 203, so that the relative position between stop elbow 300 and extension track 200 is easily perceptible to and adjustable by the user.

The adjustment device visible in the figures in the form of eccentric 203 can be positioned on one side or on both sides of the drawer. The same applies for the position of stop parts or stop elbows 300.

According to the invention, it is possible to maintain between the two walls of the drawer, or if two or more stop parts are used, between the stop pails, a distance that is constant, that is, independent of the position of the drawer or the stop parts. The advantage of this is, that the position of the extension tracks is not skewed.

The above-described adjustment mechanism could also be positioned at another place, for example on the face of stop part 300.

In addition, the adjustment mechanism could also be positioned in such manner that an alternative or additional upward adjustment of the drawer and/or the drawer face, for example vertically, is possible.

The invention claimed is:

1. A refrigerator and/or freezer comprising at least one inside container and at least one drawer that can be slid into and pulled out of the inside container, the drawer having at least one face visible to a user, the refrigerator having adjustment devices which allow the position of the drawer and thereby the position of the drawer face relative to the inside container to be adjustable horizontally, with the adjustment devices having at least one eccentric, wherein the drawer face is positioned on at least one stop part, and the at least one stop part has at least one hole through which a bolt extends, with the at least one eccentric being positioned on the bolt.

2. The refrigerator and/or freezer according to claim 1, wherein the adjustment devices are constructed in such manner that the position of the drawer or the drawer face relative to the inside container can be adjusted vertically.

3. The refrigerator and/or freezer according to claim 1, wherein the adjustment devices include at least a second eccentric being positioned on or near a side wall of the drawer, or acting on one side wall or other part of the drawer or on a part connected with the drawer.

4. The refrigerator and/or freezer according to claim 1, wherein the drawer can slide into and can be pulled out of the inside container by means of an extension track, and that the adjustment devices are at least partly positioned on the extension track.

5. The refrigerator and/or freezer according to claim 4, wherein the extension track has a stationary part and a part that slides relative to this stationary part, and that the adjustment devices are at least partially positioned on the stationary part and/or on the sliding part of the extension track.

6. The refrigerator and/or freezer according to claim 1, wherein the adjustment devices work together with the at least one stop part or with another part of the drawer.

7. The refrigerator and/or freezer according to claim 6, wherein at the least one stop part is connected with an extension track by means of which the drawer can be slid into and pulled out of the inside container.

8. The refrigerator and/or freezer according to claim 6, wherein the stop part or another part of the drawer has a wall, a stud, or another projection, or a hole or recess, and that the eccentric acts on the wall, the stud, the projection, the hole, or on the wall of the hole or recess.

9. The refrigerator and/or freezer according to claim 6, wherein the drawer and/or the drawer face is connected with two stop parts and/or that the adjustment devices work together with at least one of the stop parts or with another part of the drawer.

10. The refrigerator and/or freezer according to claim 1, wherein the bolt cannot move in the direction in which the position of the drawer and/or the drawer face can be adjusted by means of the adjustment devices.

11. The refrigerator and/or freezer according to claim 1, wherein the adjustment devices are constructed in such manner that the position of the drawer or the drawer face relative to the inside container can be adjusted sideways and/or upward.

* * * * *